US010074532B1

(12) United States Patent
Ota et al.

(10) Patent No.: US 10,074,532 B1
(45) Date of Patent: Sep. 11, 2018

(54) SEMI-ACTIVE ANTENNA STARTING AID FOR HID ARC TUBES

(71) Applicant: Eye Lighting International of North America, Inc., Mentor, OH (US)

(72) Inventors: Hitoshi Ota, Mentor, OH (US); Harold David Myers, Jr., Mentor, OH (US)

(73) Assignee: Eye Lighting International of North America, Inc., Mentor, OH (US)

( * ) Notice: Subject to any disclaimer, the term of this patent is extended or adjusted under 35 U.S.C. 154(b) by 0 days.

(21) Appl. No.: 15/915,061

(22) Filed: Mar. 7, 2018

Related U.S. Application Data

(60) Provisional application No. 62/467,935, filed on Mar. 7, 2017.

(51) Int. Cl.

| | |
|---|---|
| ***H01Q 1/26*** | (2006.01) |
| ***H01J 17/30*** | (2006.01) |
| ***H01J 17/44*** | (2006.01) |
| ***H01J 61/54*** | (2006.01) |
| ***H01J 61/36*** | (2006.01) |
| ***H01J 61/073*** | (2006.01) |

(52) U.S. Cl.
CPC ..... *H01J 61/54* (2013.01); *H01J 61/073* (2013.01); *H01J 61/366* (2013.01); *H01Q 1/26* (2013.01)

(58) Field of Classification Search
CPC ..... H01J 61/54; H01J 61/073; H01J 61/366; H01Q 1/26
USPC ..... 315/34; 313/594, 595
See application file for complete search history.

(56) References Cited

U.S. PATENT DOCUMENTS

| | | | | |
|---|---|---|---|---|
| 6,051,927 | A * | 4/2000 | Graser | H01J 61/22 313/570 |
| 2003/0193292 | A1* | 10/2003 | Hecker | H01J 61/547 313/595 |
| 2011/0115371 | A1* | 5/2011 | Steere | H01J 61/547 313/594 |
| 2018/0114688 | A1* | 4/2018 | Qian | H01J 61/54 |

* cited by examiner

*Primary Examiner* — Daniel D Chang
(74) *Attorney, Agent, or Firm* — Dwight A. Stauffer Patent Services

(57) ABSTRACT

A starting aid for discharge lamp arc tubes is characterized by an arc tube having a tubular body wall that longitudinally extends between first and second ends and surrounding an internal arc cavity with first and second electrodes that have conductive feedthroughs to electrically connect to corresponding first and second external arctube leads; an antenna conductor extending longitudinally on an outside surface of the arc tube wall between first and second antenna ends that are located radially outward of corresponding first and second electrodes; and an antenna coupling member comprising a conductive coupling connector that is electrically connected to the first arctube lead, and extends to a coupling end located on the body wall near to the first antenna end and separated from it by a coupling gap of predetermined, non-zero gap dimension.

3 Claims, 13 Drawing Sheets

Arc length : 172 mm
Starting aid : Standard Printed Antenna (passive)
vs. (same arctube with wire added to make an active version)
Ballast : Electronic (High Freq.)
Readings taken after 100 hrs aging = Weld = Weld = Weld = Weld

SEMI-ACTIVE ANTENNA STARTING AID FOR HID ARC TUBES

CROSS-REFERENCE TO RELATED APPLICATIONS

This application claims the benefit of U.S. Provisional Patent Application No. 62/467,935 filed Mar. 7, 2017, said application hereby incorporated in its entirety by reference herein.

TECHNICAL FIELD OF THE INVENTION

The present invention relates to arc discharge lamp ignition starting aids and, more particularly to starting aids comprising an antenna outside of the arc tube.

BACKGROUND OF THE INVENTION

Generally speaking, high intensity discharge (HID) arc tubes need help starting an arc between electrodes at opposed ends because typical operating voltage levels are not high enough to initiate an arc. Historically the starting method has involved supplying high voltage spikes to the lamp lead-in wires during lamp startup. The spikes or pulses are generally provided by "ignitor" circuitry/components that are usually outside the lamp jacket, typically as part of the ballast, therefor the lamp supply wiring and lamp socket connectors must be able to deliver the maximum pulse voltage without arcing. FIGS. 1A (magnetic ballast with ignitor) and 1B (electronic/EL ballast with high frequency ignition circuitry) illustrate starting pulse waveforms typical of present ballasts. The EL ballasts supply operating power, and superimpose high frequency (e.g., about 200 kHz), high peak voltage ignition pulses that are repeated (e.g., every second) until arc ignition is achieved.

Adjusting HID lamp design factors to increase lamp performance can make the arc harder to start, and it has become very difficult to economically and safely supply starting voltage spikes any higher than they are now (e.g., ~3 kV superimposed on the steady state lamp supply voltage).

It is known that ignition waveform requirements such as spike/pulse peak voltage can be decreased by using starting aids such as antennas and/or UV ionization sources. Conversely this means that starting aids can enable higher performance lamp designs that start more reliably at existing peak starting voltage. This is illustrated in FIG. 2, where starting reliability for different types of antenna starting aids are compared to starting without an antenna starting aid.

For example, in HID lamps the radiant output in desired spectrum bands (e.g., PAR radiation for horticultural lamps) can be improved in various ways by increasing the cold fill pressure of xenon gas, and/or by modifying other design factors such as the arc gap, etc., however such design changes raise the starting voltage requirement. High performance HID lamps have been pushing the envelope until they are limited by starting aid capabilities, therefor an improved starting aid is needed.

A known starting aid for arc tubes made with PCA (PolyCrystalline Alumina) such as in HPS (high pressure sodium) and CMH (ceramic metal halide) lamps, is called an "antenna", which is a wire-like conductor extending longitudinally along the arc tube (usually outside of it) between the two electrodes. It is sufficient for the antenna to bridge the arc gap with antenna ends located radially outward (above or outside) of each of the two electrodes, and may include conductive rings around the tube that are electrically connected to each antenna end. As such, this is called a "passive antenna" because it is electrically floating and can be inductively charged by the AC voltage being applied across the nearby electrodes. A preferred implementation of this is where the conductors are applied ("printed") on the outside arc tube wall and bonded by sintering.

As shown in FIG. 2, a much more effective antenna is an "active antenna" where the antenna is electrically connected to at least one of the electrode lead wires. The problem with this is that having a live wire (always-charged conductor) near the arc tube wall causes metal ion migration away from the arc (e.g., "sodium loss") which collects on the inner arc tube wall, leading to deterioration of the wall. The ions may then migrate through the wall, which in worst case scenarios creates a conductive path to the outside of the arc tube which bypasses the internal arc gap to cause a catastrophic failure.

Thus recent design efforts have been directed to development of a starting aid that provides the benefits of an active antenna, but avoids its problems, thus allowing design changes to further improve performance without causing starting problems. For convenience in the present disclosure, where the improved starting aid is based on an antenna, we may call it a "semi-active antenna".

U.S. Pat. No. 8,456,087 to Steere et al. and assigned to Koninklijke Philips Electronics N.V. (the Philips '087 patent) discloses a "High-Pressure Sodium Vapor Discharge Lamp With Hybrid Antenna" comprising an HID lamp arctube wherein a printed antenna is indirectly coupled to an electrode lead to produce a "hybrid antenna". This is described with reference to drawings such as their FIG. 4D that is reproduced herein as FIG. 3 (Prior Art). Summarizing the Philips '087 disclosure: an exemplary HPS (HID) lamp 200 has an antenna lead 212 that is a conductor extending from the antenna main part (206) to a point close to the electrode feedthrough 208 in a lead-in hole 223, where the antenna lead is separated a distance PD from the electrode lead (feedthrough) by sealing frit 210, which may be electrically conductive with a resistance, or may be substantially nonconductive. The antenna lead 212 may extend 213 inward on a portion of the inner wall 240 of the lead-in hole 223. The separation distance PD may be in the range of 20-100 microns, resulting in a resistive and/or capacitive coupling between the antenna 206 and one or both electrodes 236.

Thus the "hybrid antenna" appears to be Philips' implementation of an antenna wherein the printed antenna is indirectly (capacitively and/or resistively) coupled to an electrode lead by means of an electrical conductor that is connected to, and extends from, the printed antenna to the end of the arctube and continues around the end down toward the electrode lead.

It is an objective of the work disclosed herein to develop a novel form of antenna that enables improvement of HID arc tube performance while avoiding starting problems and/or other negative effects like those described above.

BRIEF SUMMARY OF THE INVENTION

A starting aid for discharge lamp arc tubes that are characterized by a tubular arc tube body wall that longitudinally extends between first and second ends and surrounds an internal arc cavity wherein corresponding first and second electrodes in the arc cavity have corresponding first and second conductive feedthroughs that sealingly extend out through the first and second ends (typically through sealing end plugs, and electrically connected to corresponding first and second external arctube leads). According to the invention, the starting aid is an antenna being an elongated (e.g., wire-like) conductor extending longitudinally on the arc tube body wall between first and second antenna ends that are located radially outward of corresponding first and second electrodes; and an antenna coupling member comprising a conductive coupling member lead that is electrically connected to the first feedthrough (e.g., arctube lead), and extends to a coupling end located on the body wall near to the first antenna end and separated therefrom by a coupling gap of predetermined, non-zero gap dimension.

In an adjacent conductor type of coupling member the coupling gap is an air gap, the coupling member is on an outside surface of the body wall, and both the coupling end and the antenna end extend circumferentially around the arctube.

- gap dimension "g" is at least 0.5 mm
- gap dimension "g" is less than or equal to 1.0 mm
- antenna is printed on the wall (preferably on the outside surface)
- antenna end=ring (circumferential)
- coupling end is a ring
  - ring=wide band . . . wire . . . end cap/cup including bottom covering the end plug
  - ring is printed
  - printed ring+printed connector+printed connector ring+connection band clamped around connector ring+coupling connector
- coupling end and antenna end are parallel rings (constant gap dimension)
- coupling connector=wire connected to coupling end ring
- a frame forms a portion of the coupling connector conductive path
- coupling end is a printed ring+coupling connector is printed on arctube body wall and continues on at least a portion of the arctube end
  - a sealing end plug is indented within the arctube end and the connector is printed on an exposed part of the arctube end, and on an inside surface of the body wall
  - the frame is shaped to conform to indented end to press against connector there For a layered capacitive coupling member, the coupling end is a conductive band wrapped around the arctube body radially outward from the antenna end (preferably ring shaped) and separated by a dielectric band layered therebetween to form a dielectric gap of dimension "c".

Other objects, features and advantages of the invention will become apparent in light of the following detailed description, drawings, and claims.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1A:
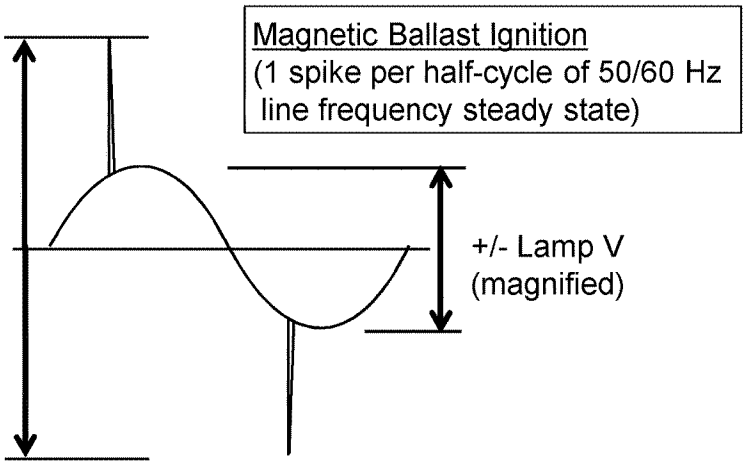
Figure 1B:
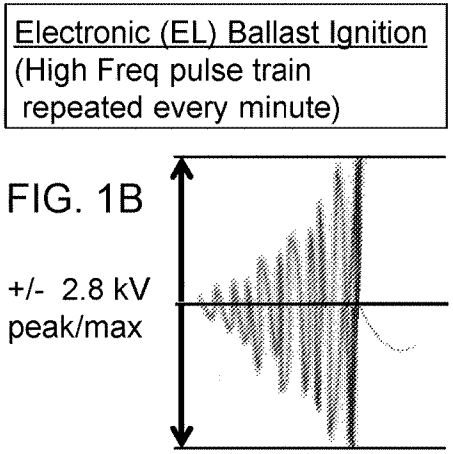

The structure, operation, and advantages of the present preferred embodiment of the invention will become further apparent upon consideration of the following description taken in conjunction with the accompanying drawings, wherein:

FIGS. 1A-1B illustrate typical ignitor waveforms.

Figure 2:
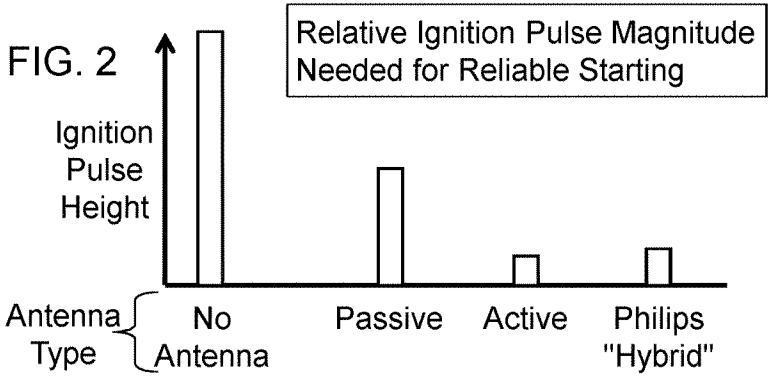

FIG. 2 is a chart showing relative ignition pulse magnitude needed for reliable starting of different starting aid antenna types according to the prior art.

Figure 3:
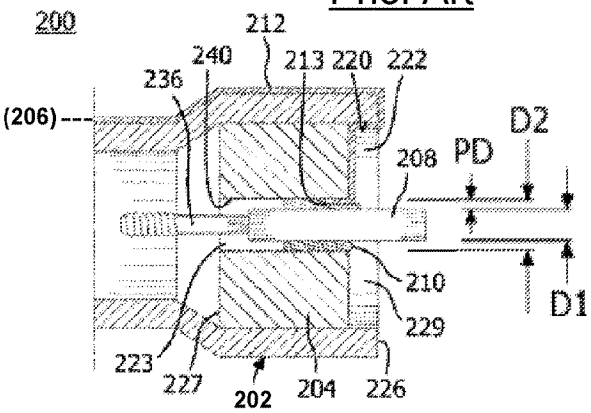
FIG. 3 Prior Art

FIG. 3 is a drawing figure copied from a prior art Philips patent to illustrate their "hybrid antenna".

Figure 4:
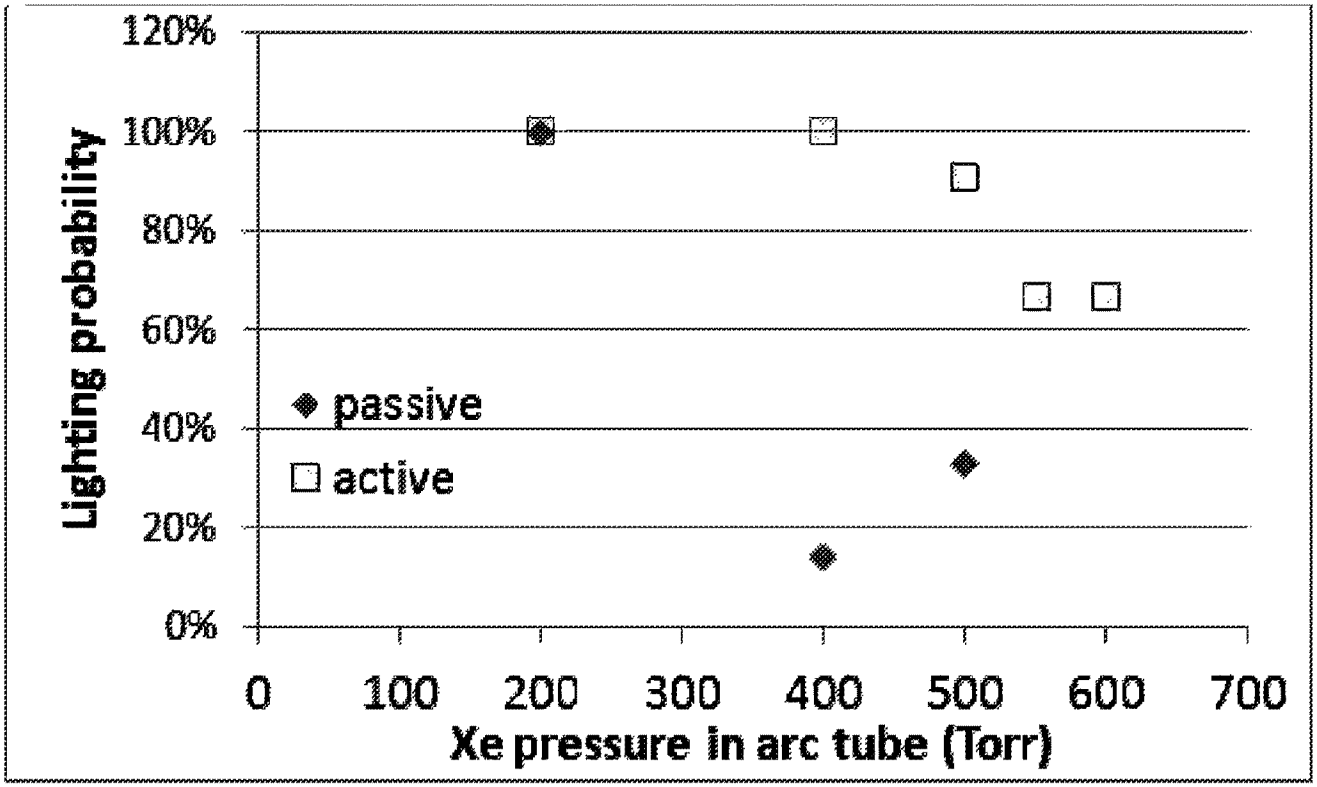

FIG. 4 is a chart reporting results of a test comparing starting probability for arctubes at different fill pressures with active versus passive antennas.

Figures 5A, 5B:
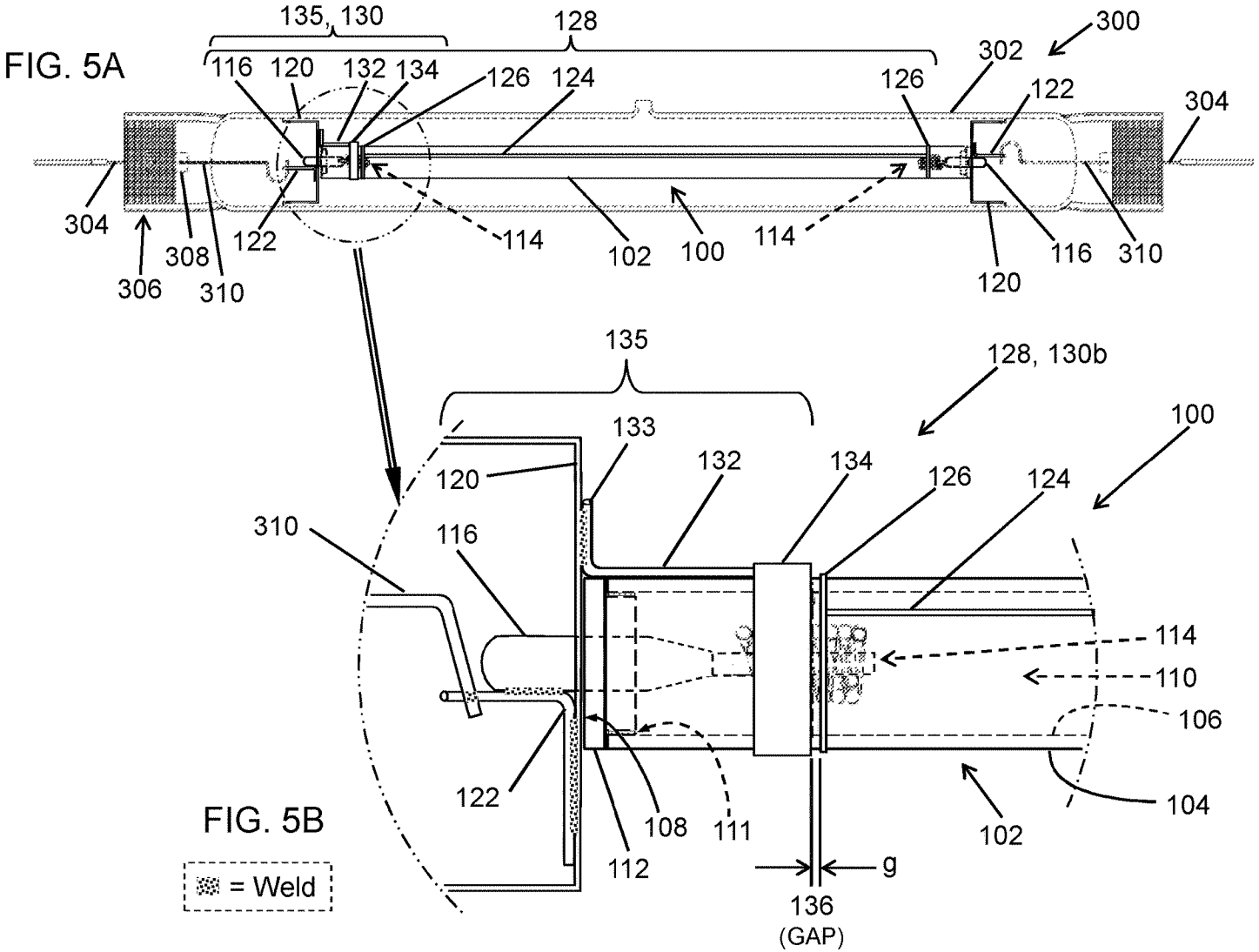

FIG. 5A is a plan view of an HPS lamp having a ceramic arctube sealed inside a double ended tubular quartz outer jacket, and also showing an embodiment of a starting aid according to the present invention.

FIGS. 5B-5Fb are magnified detail views of an arctube end portion showing example embodiments of starting aids utilizing an adjacent conductor type of coupling member, all according to the present invention.

Figure 5C:
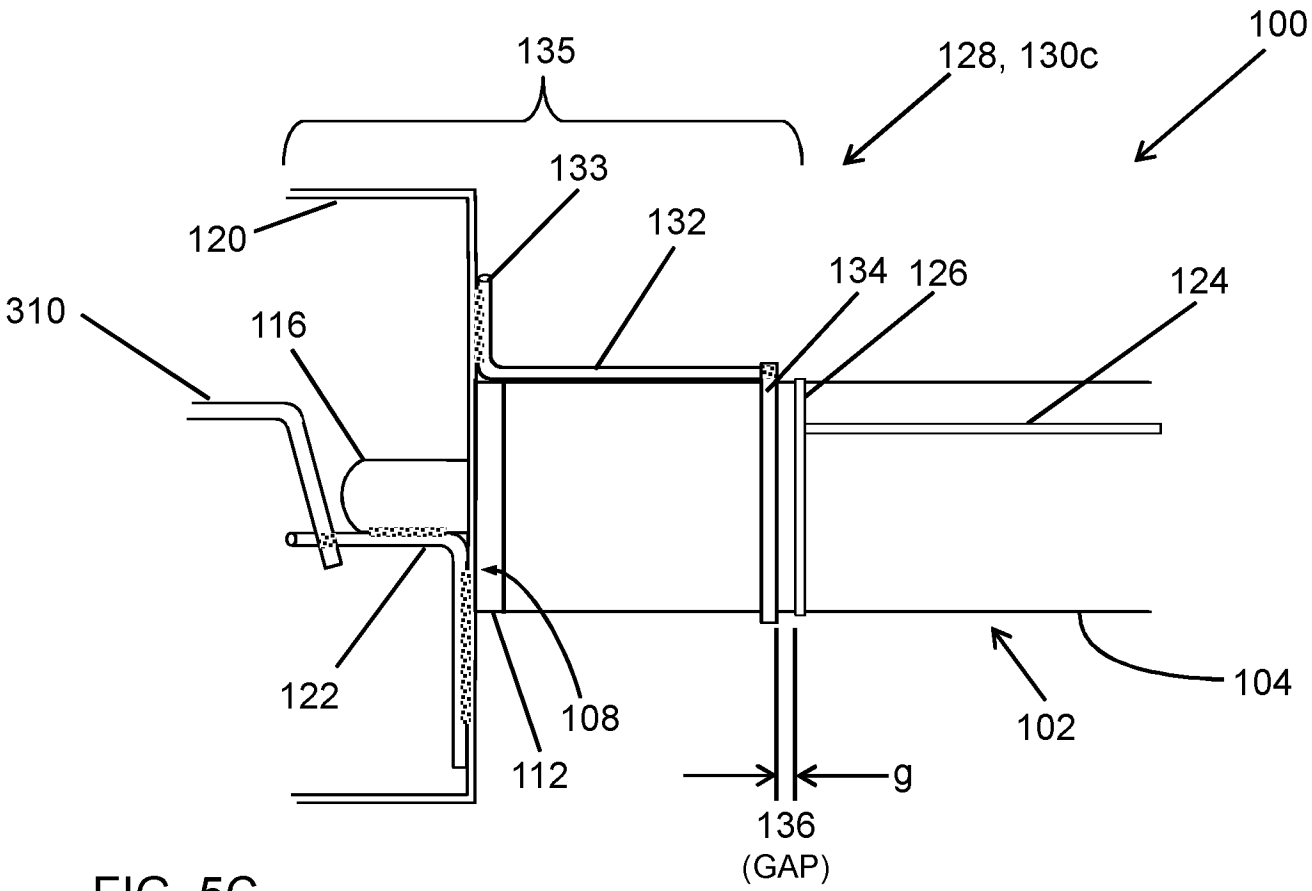
Figure 5D:
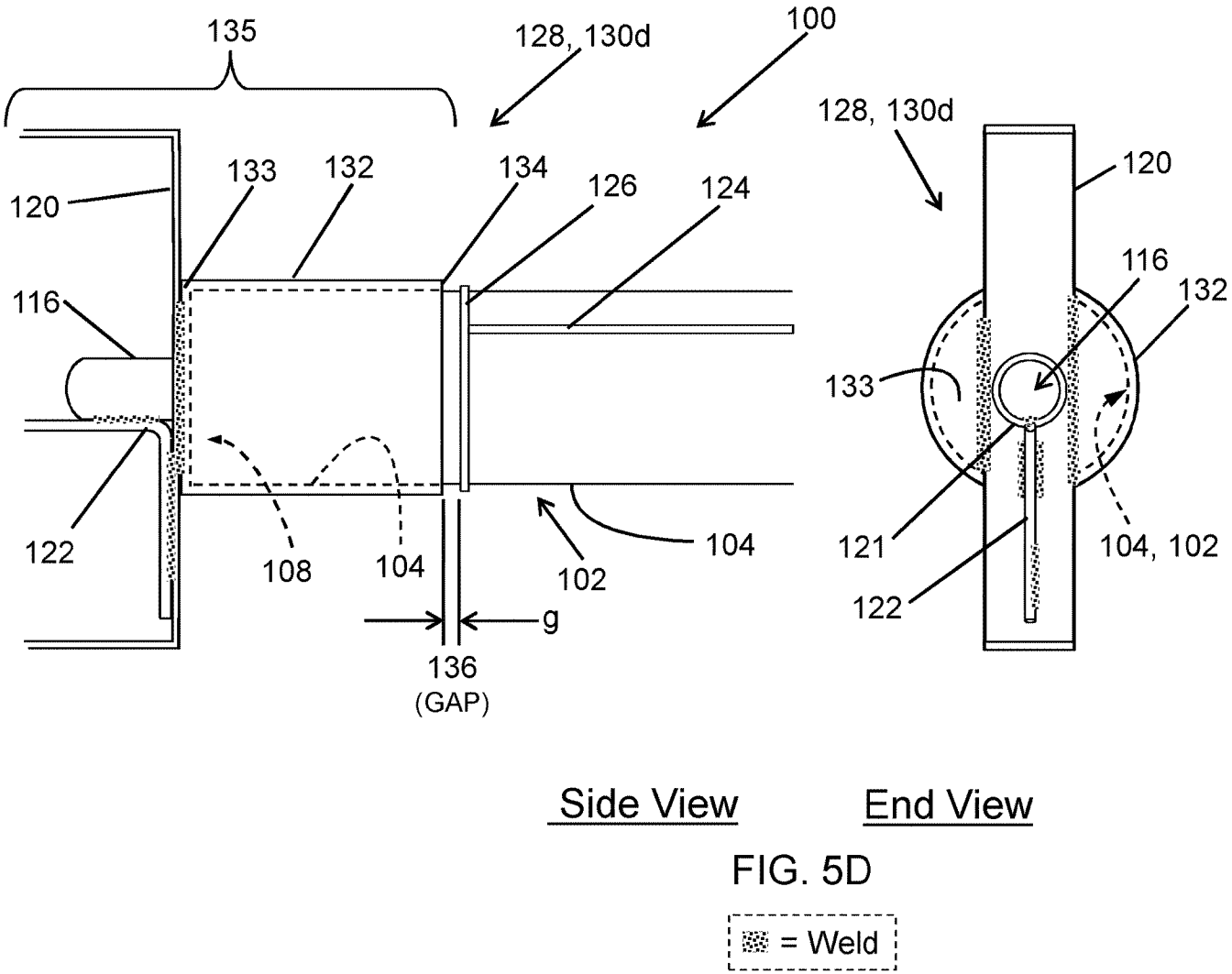
Figure 5E:
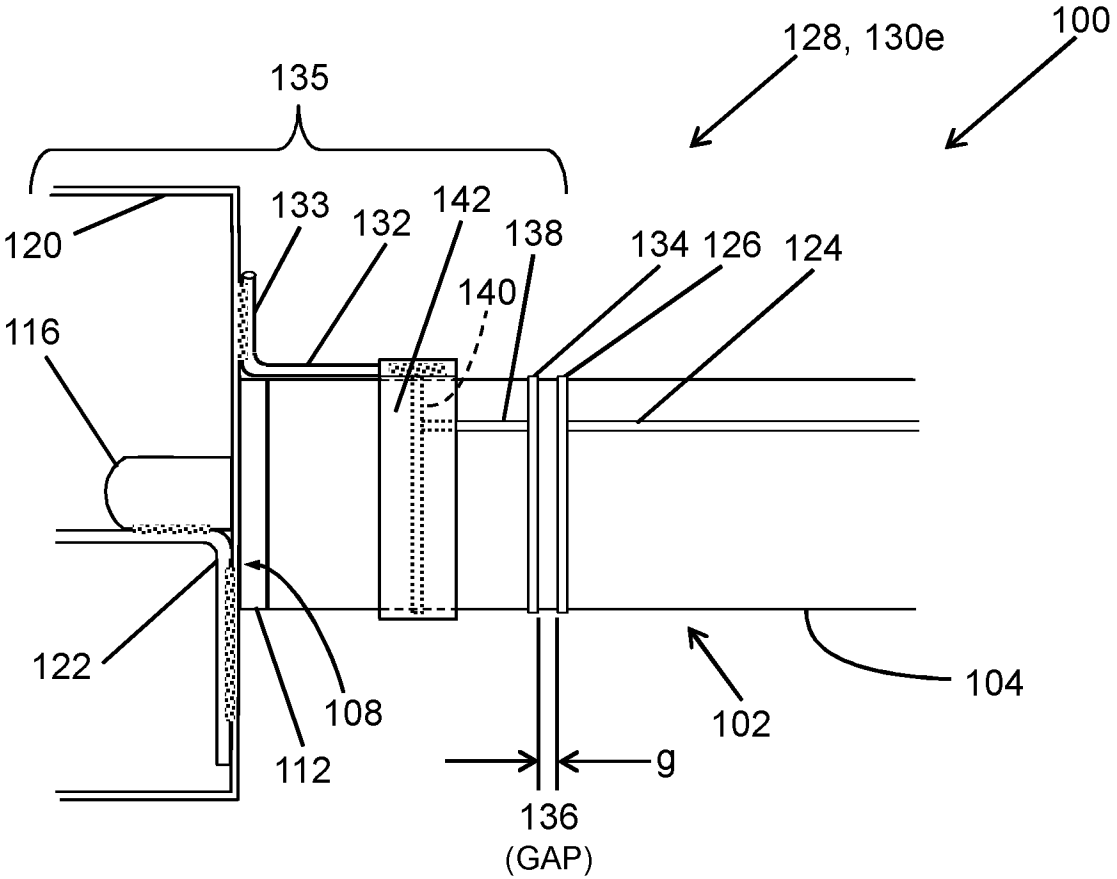
Figure 5F:
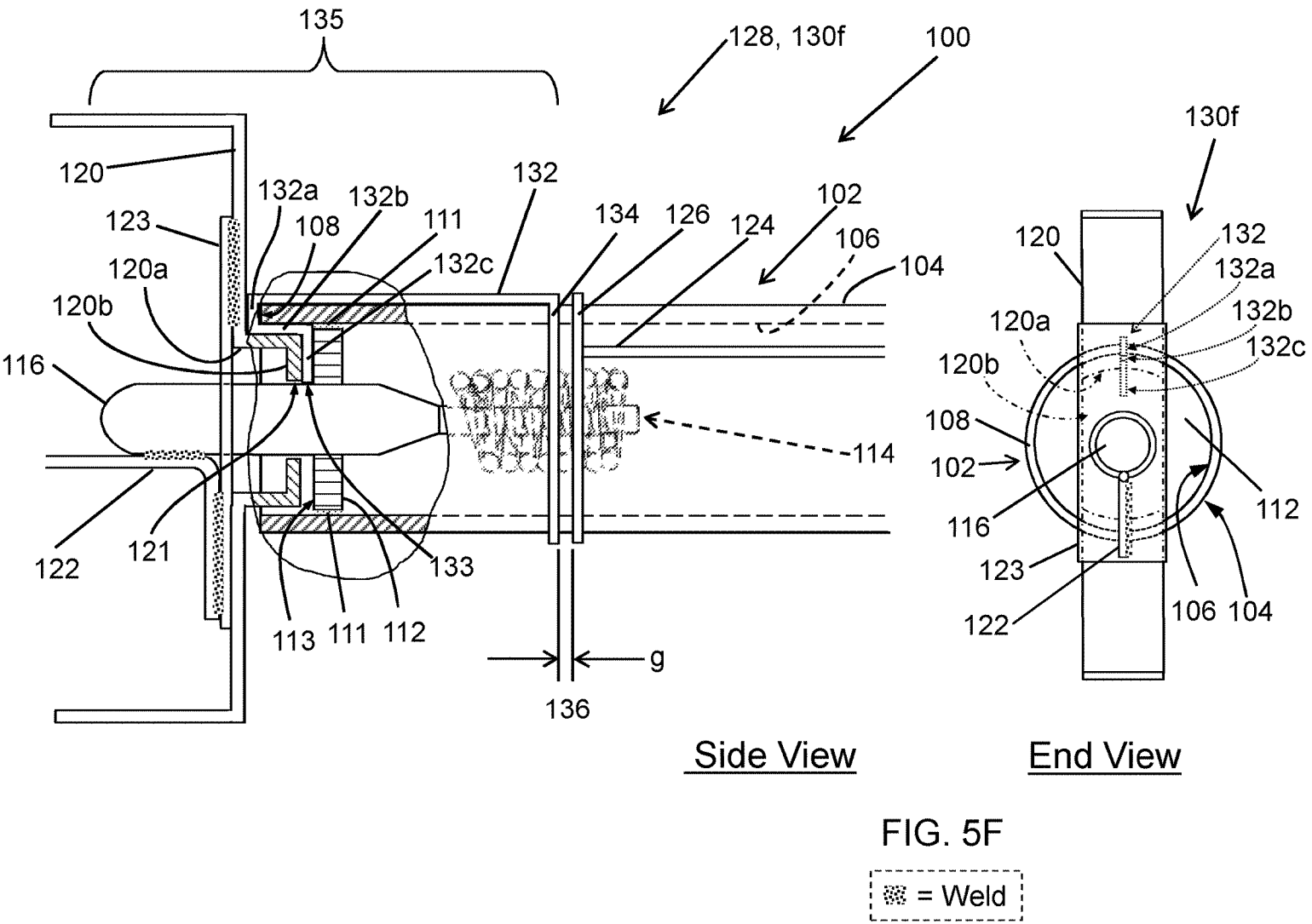
Figure 5F:
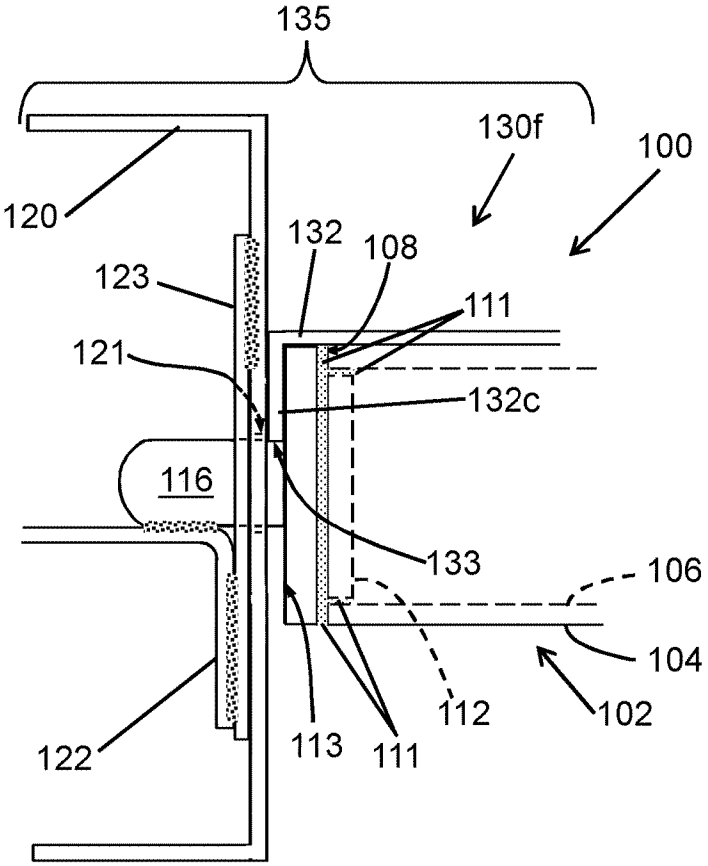
Figure 5F:
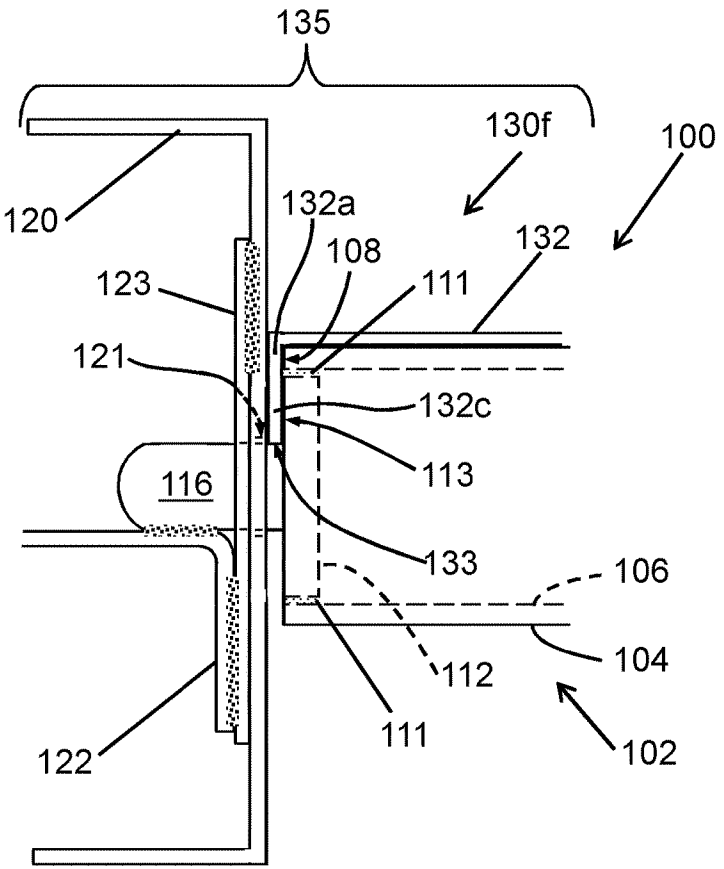

FIGS. 5D and 5F provide both side and end views, and FIG. 5F further shows a cross-section view of a portion within a delineated cutout area.

FIGS. 5Fa-5Fb are partial views of the starting aid concept of FIG. 5F, showing alternative implementations of the coupling connector for different end plug configurations, all according to the present invention.

Figure 6:
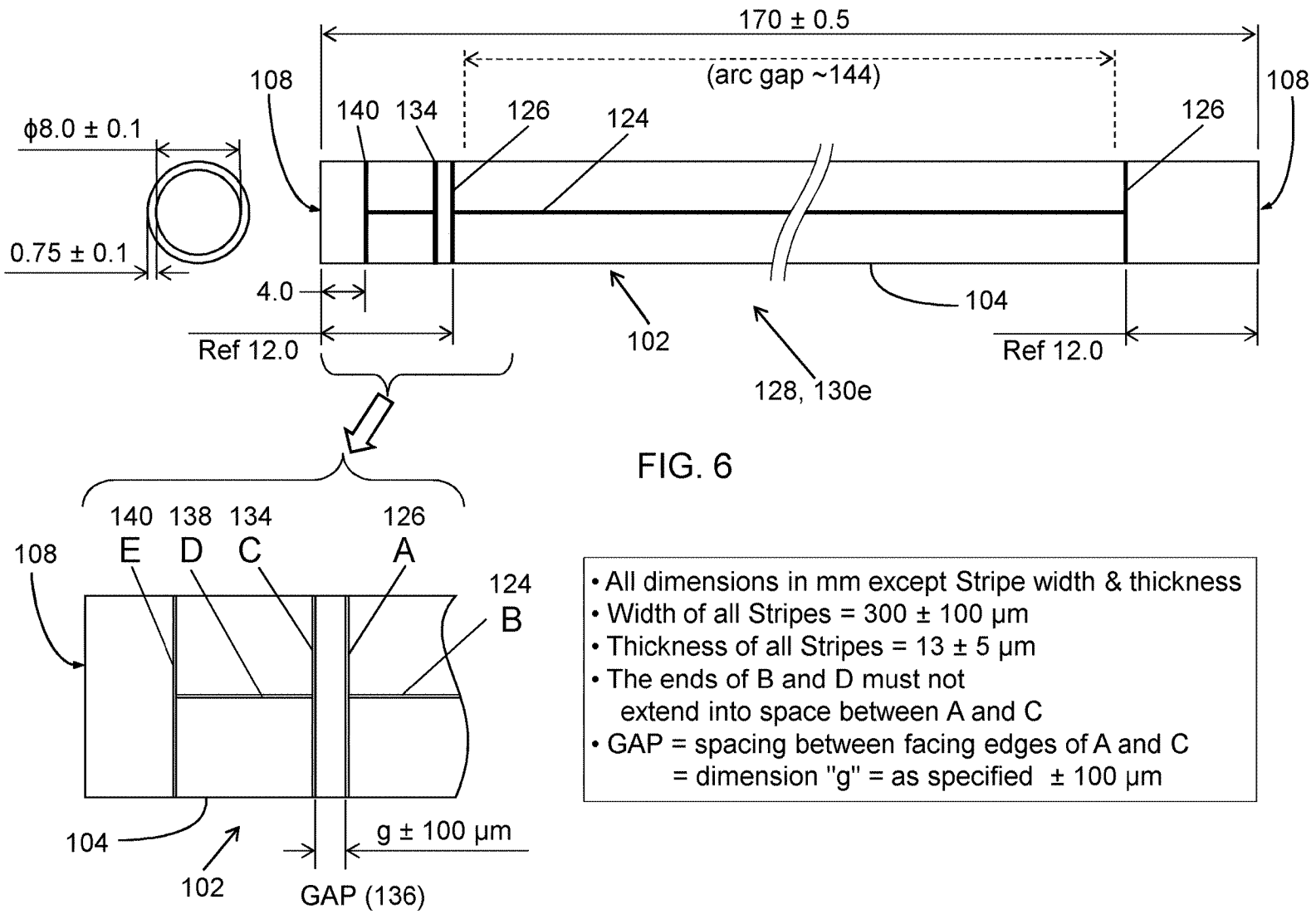

FIG. 6 is an exemplary construction drawing with side, end, and detail views, of an arctube having coupling member elements printed on the arctube along with a standard antenna, designed according to the present invention as shown in FIG. 5E.

Figure 7:
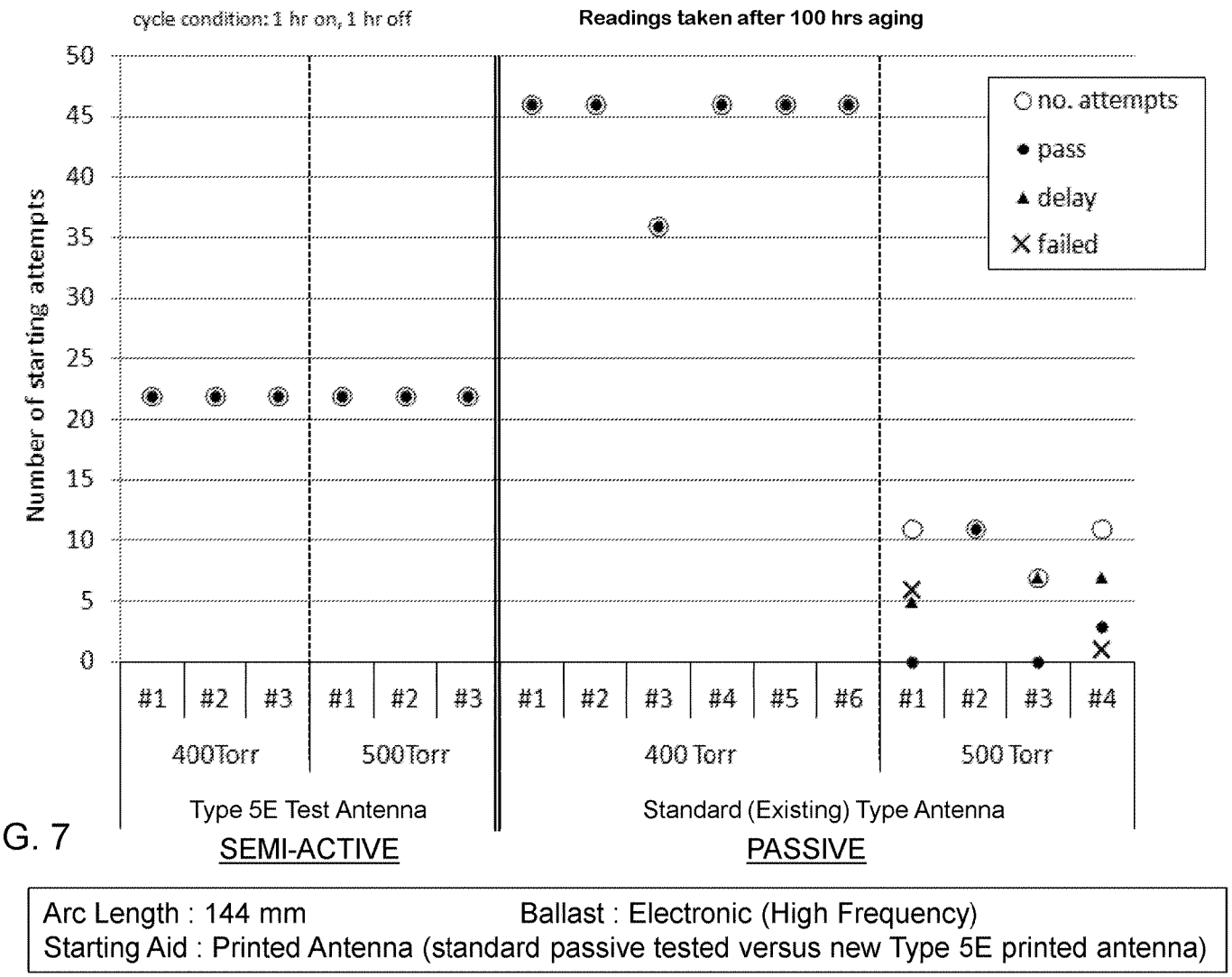

FIG. 7 is a chart reporting results of a test of starting reliability for arctubes at different fill pressures and comparing a short arc length arctube made with a standard passive antenna versus the same arctube made according to the present invention with the starting aid shown in FIG. 5E.

Figure 8A:
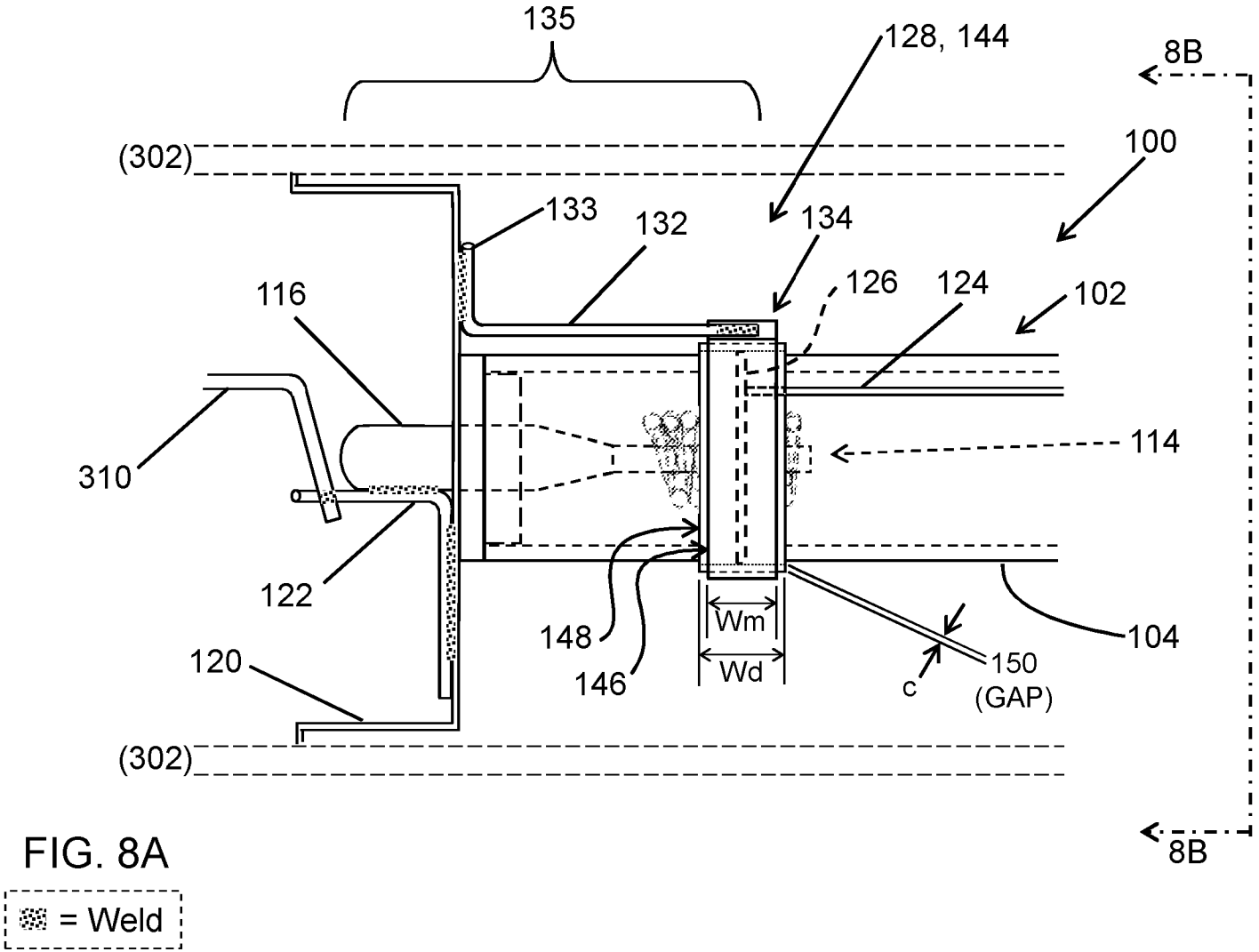
Figure 8B:
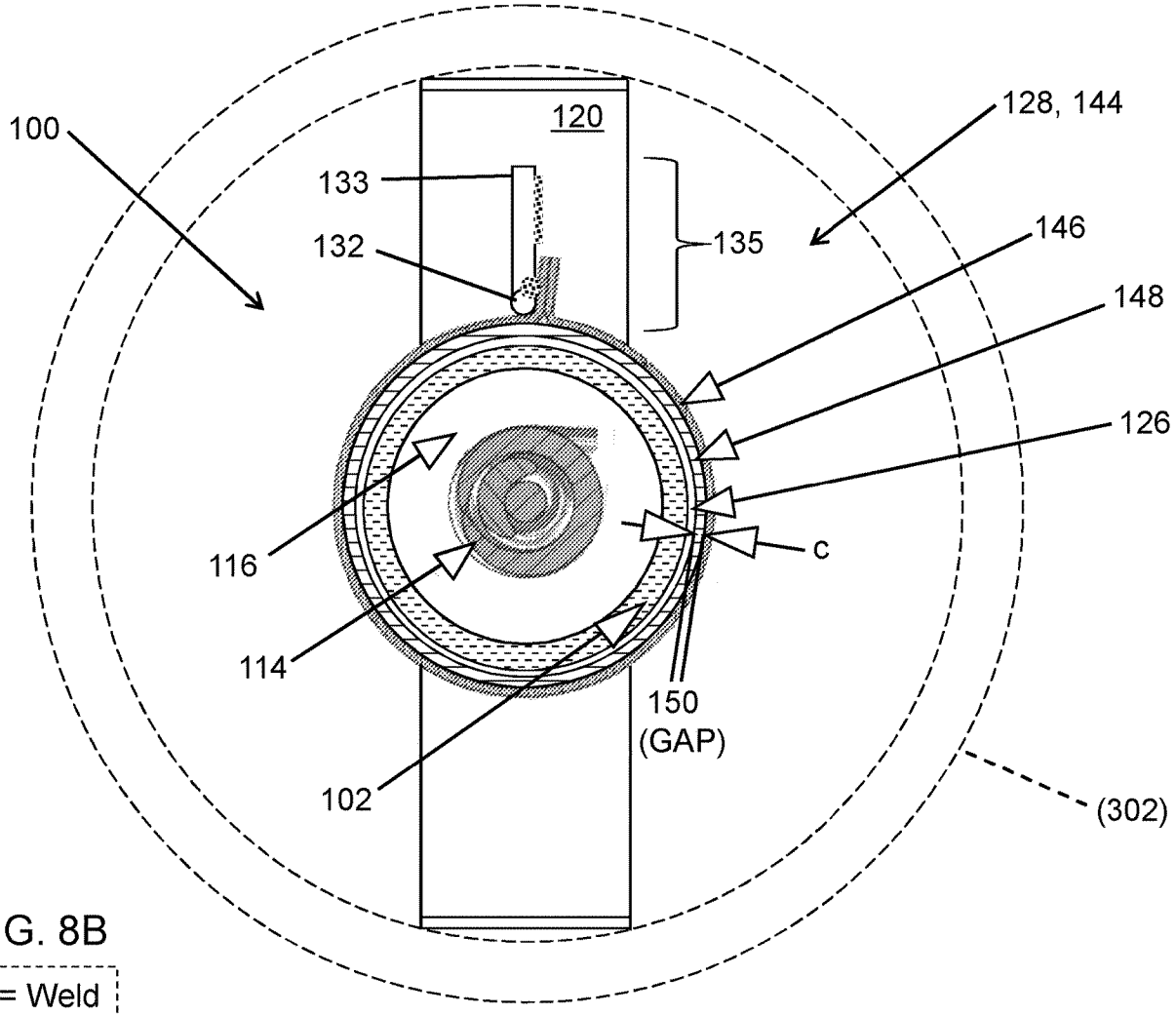

FIGS. 8A and 8B show a side view and a cross section axial view (in direction indicated by the line 8B-8B), of an arctube end portion showing starting aids utilizing a layered capacitive coupling type of coupling member for a starting aid according to the present invention.

Figure 9A:
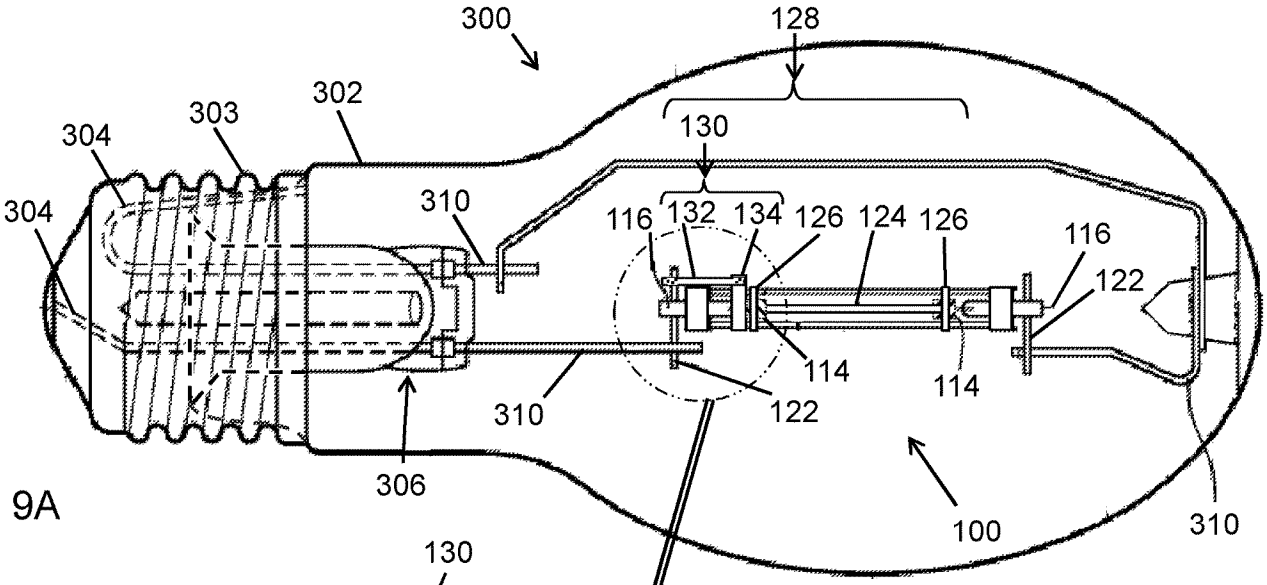

FIG. 9A is a plan view of an HPS lamp having a ceramic arctube sealed inside a single ended screw based outer jacket, and also showing a starting aid implemented on the arctube according to the present invention.

Figure 9B:
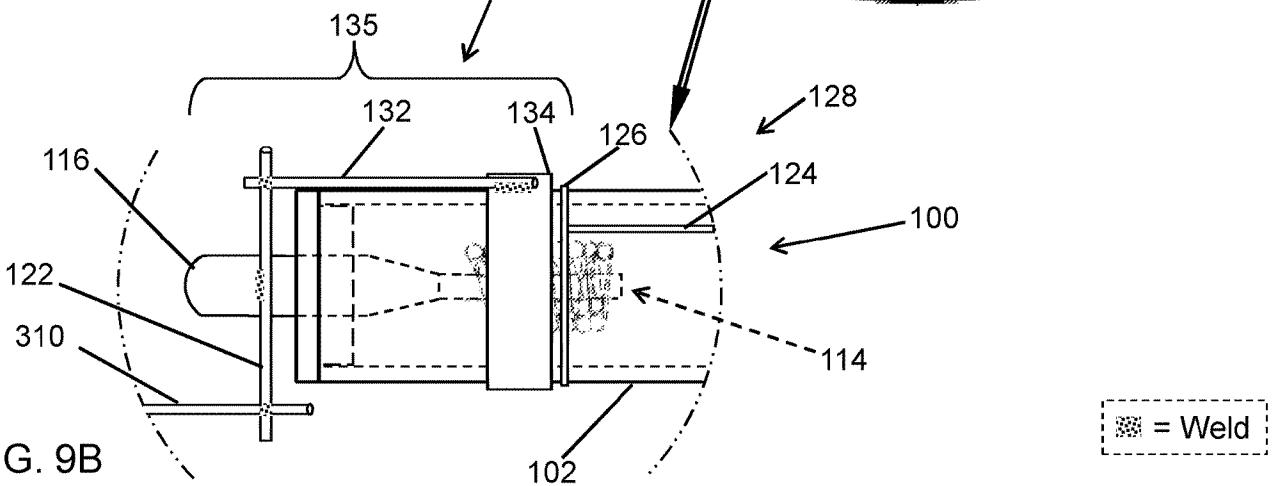

FIG. 9B is a magnified detail view of an arctube end portion showing how the starting aid embodiment of FIG. 5B may be manufactured using components suitable for use in a different HPS/HID lamp mounting structure, all according to the present invention.

DETAILED DESCRIPTION OF THE INVENTION

The following table is a glossary of terms and definitions, particularly listing drawing reference numbers or symbols and associated names of elements, features and aspects of the invention(s) disclosed herein.

| REF. | TERMS AND DEFINITIONS |
|---|---|
| 100 | arc tube (arctube) part(s) of a discharge lamp (e.g., HID). Especially those with a tube/body 102 made of PCA (translucent ceramic) as in HPS and CMH arctubes/lamps. |
| 102 | arctube body-tubular wall |
| 104 | (radially) outer surface of the arc tube |
| 106 | (radially) inner surface of the arc tube |
| 108 | arctube end(s) |
| 110 | arc cavity (internal) |
| 111 | frit used to seal end plug to arctube wall. Unless stated otherwise, conventional manufacturing methods for frit sealing of PCA arctubes should be assumed even if frit is not shown or labeled in a drawing. |
| 112 | end plug(s), shown in two forms: internal plug style (FIGS. 5F, 5Fa) which is a disc that fits inside the arctube; and end-cap style which is an inside plug disc combined with a capping disc that has the same OD as the arctube (FIGS. 5Fb and 5A-5E, 8A, 9B). The FIGS. 5F, and 5Fa show two different sealing configurations for the internal plug style: indented, and flush with end of arctube, respectively. |
| 113 | outer surface of end plug (axially and radially outside for end-cap style) |
| 114 | electrode(s) separated by an arc gap (dimension) across which an arc discharge must be started and then maintained during lamp operation. |
| 116 | electrode feedthrough(s) |
| 120 | frame/support(s) for holding arctube within lamp outer jacket 302<br>Is typically attached to arctube end by welding to the feedthrough 116, e.g., by an intermediate frame connector (wire) 122 that is welded to both. |
| 120a,b | portions of frame that are indented to fit into cavity at end of arctube with indented plug |
| 121 | end/edge of frame closest to the feedthrough, especially for indented frame |
| 122 | frame connector, mechanical/electrical connecting wire typically welded to frame 120 and to feedthrough 116. May also connect to inner lamp lead 310. |
| 123 | extra sheet metal covering indented part(s) 120a, 120b of indented frame. Used to help press frame against arctube end 108, especially when printed connector 138 extends around the end (e.g., portion 138a) |
| 124 | antenna = a conductor extending longitudinally on the arc tube wall between first and second antenna ends 126 located radially outward of corresponding first and second electrodes. There are many known forms of this, which may be active or passive depending upon whether or not it is electrically connected to an electrode lead. A preferred form of antenna is manufactured by a known "printing" process where the conductive material is deposited on the arctube outside surface 104 and sintered to fuse with the arctube material. |
| 126 | antenna end(s), may be a ring around the circumference of the arctube, for better coupling with the electrode. |
| 128 | Semi Active Antenna Starting Aid, an antenna coupling member added to an otherwise unconnected (passive) antenna.<br>Two kinds disclosed, determined by type of antenna coupling member used:<br>130 = adjacent conductor type, e.g., FIGS. 5B-5F or<br>144 = layered capacitive coupling type, e.g., FIGS. 8A-8B<br>Antenna Coupling Members 130, 144 generally comprise a coupling end 134 and a coupling member lead 135 that electrically connects the coupling end to the feedthrough 116 |
| 130 | adjacent conductor type of coupling member<br>Example embodiments may be referenced by the FIG. number 5B-5F of the corresponding illustration. Alternatively, the embodiments may be referenced as 130b-130f in accordance with the FIG. 5 suffix letters B-F, respectively. |
| 132 | coupling connector, a portion of the coupling member lead that extends along the arctube from the coupling end 134 toward the arctube end 108. |
| 132a, b, c | for printed version of coupling connector, these are portions that may be printed on the arctube end 108, inner wall 106, and plug outer surface 113, respectively. This may mean that the printed connector must cross a gap that may have frit 111 fused in place to seal the plug 112 to the arc tube body 102. |
| 133 | end of the coupling connector, usually connected (e.g., welded) to the frame 120 |
| 134 | coupling end of the antenna coupling member, preferably a ring, preferably parallel to a ring shaped antenna end 126. May be printed or formed from conductors such as wire, sheet metal and the like. |
| 135 | coupling member lead, a continuous electrically conductive path between the coupling end 134 and the feedthrough 116, thereby connecting to both the electrode 114 inside the arctube, and to the power supply line (e.g., inner lamp lead 310).<br>The conductive path may include one or more electrically connected portions such as 138, 140, 142, 132, 120, 122, 123, 121, and/or 133.<br>The lead, or portions of it, may be printed on the arctube or end plug; or may be a wire, a band, a washer, a frame, an end cap, or other suitable conductive materials as disclosed. |
| 136, g | coupling air gap, non-conducting separation between coupling end and an adjacent antenna end, having a predetermined, non-zero gap dimension "g" (using an adjacent conductor type of coupling member 130) |
| 138 | printed connector/connecting conductor. Extends on the arctube outer surface 104 from a printed coupling end (e.g., ring) 134 to a printed connector ring 140. |
| 140 | printed connector ring |
| 142 | connection band applied around the circumference of arctube and mechanically tightened to make electrical connection by pressing against an underlying conductor (e.g., printed connector ring 140) |
| 144 | layered capacitive coupling member |
| 146 | capacitive coupling band, functions as the coupling end 134 of the layered capacitive |
| Wm | coupling type of coupling member 144- Has width "Wm" measured in axial direction. |

-continued

| REF. | TERMS AND DEFINITIONS |
|---|---|
| 148 | dielectric band located between coupling band 146 and antenna end ring 126 (and also the arctube body 102). |
| Wd | Has thickness "c" which establishes a dielectric coupling gap 150<br>Has width "Wd" measured in axial direction |
| 150, c | dielectric coupling gap having a predetermined, non-zero gap dimension "c" |
| 300 | HID discharge lamp with an arctube 100 inside an outer jacket 302. FIGS. 5A and 9A show the inventive starting aid implemented in a double ended and a single ended lamp, respectively. |
| 302 | outer jacket or envelope of lamp. May be tubular double ended, single ended with a base, etc. depending upon the type of HID lamp 300. Quartz or hard glass may be used as appropriate. |
| 303 | lamp base (e.g., metal screw cap on a single ended lamp) |
| 304 | outer lamp lead(s), power supply line connection outside of jacket 302 of discharge lamp 300 |
| 306 | Hermetic seal of the outer jacket (e.g., quartz pinch, or hard glass stem press with suitable lead wires.) |
| 308 | sealing portion of the lead wires 304, e.g., metal foil portion of lead wire for sealing in quartz |
| 310 | inner lamp lead(s), power supply line(s) inside of jacket 302, electrically connected to arc tube feedthrough(s) 116, e.g., via (frame) connector wire 122. |

The invention(s) will now be described with reference to the drawings using the reference numbers and symbols listed in the above table.

The present disclosure defines an HID arctube "semi-active" antenna as being an antenna-like starting aid that behaves like an active antenna during arc tube starting, but otherwise behaves like a passive one. In a crude way, this has been done previously by placing a bimetal switch in the connection between antenna and electrode lead, but this is relatively expensive, potentially unreliable, and is very difficult to place within the outer jacket of an HID lamp, especially those in a tubular jacket, e.g., a tubular double ended (DE) lamp. As described above, at least Philips has achieved the desired behavior with their "hybrid antenna" by indirectly coupling the antenna to an electrode lead, e.g., capacitively, or possibly through a high resistance link. When the high voltage, high frequency ignition pulses of an electronic ballast are applied to the supply side of the antenna coupling, a corresponding voltage may be induced on the antenna side, thereby providing a high voltage drop across the short gap between the distal electrode and the antenna above it. Once an arc starts, the high frequency/high voltage ignition pulses stop and, like all antenna types, the antenna has no effect on the arc because the high voltage gradient has been removed. Furthermore, like a passive antenna, the hybrid antenna (and our semi-active antenna) does not cause sodium migration because the indirect coupling doesn't charge the antenna sufficiently at normal steady state operating conditions.

In the present semi-active antenna 128 development, we have designed new forms of indirect coupling (e.g., members 130, 144) to an otherwise passive antenna embodiment (e.g., antenna conductors 124, 126), and have then proceeded to determine effective design limits such as dimensions (g, c) for a coupling gap 136, 150. In particular, we have devised configurations for an air gap 136 and for a dielectric gap 150.

Referring to FIG. 5A, development work focused on a 1000 W DE (Double Ended) HPS (High Pressure Sodium) horticultural lamp 300 with a PCA ceramic arc tube 100 and a tubular fused silica (quartz) outer jacket 302, however the means used to achieve the objectives are expected to be applicable to other wattages and to other HID lamps such as the ceramic metal halide (CMH) type. FIGS. 9A-B show that the herein disclosed starting aid 128 design concept(s) are not limited by the lamp 300 and jacket 302 in which the HID arc tube 100 is mounted, particularly because the aid components do not significantly increase the dimensions of the arctube 100 and are adaptable to existing support/mount structures (e.g., frame 120, connecting wires 122). The herein disclosed semi-active antenna 128 uses a coupling member applied to the outside of a PCA arctube and adds conductive elements to electrically connect to the arctube feedthrough. Although existing mount structure components may be used as convenient, they are not required since they may be circumvented by a suitable conductor added to the arctube.

It is known that radiant output such as PAR output can be increased, for example, by raising the Xe fill pressure and/or other things, but arc tubes with a passive antenna cannot be reliably started if they have more than about 300-400 Torr cold fill pressure, as shown in the test results plotted in FIG. 4. However, changing to an active antenna without any other design changes (and using the same ballast type and ignition voltage) is shown to produce reliable starting results for pressures up to about 500 Torr. It is anticipated that other arc tube design factors (e.g., arc gap) will be changed along with increased fill pressure in order to optimize the design to meet the objective specs. These test results confirm that an active or semi-active antenna is required for the objective lamp design wherein cold fill pressures above 400 Torr are likely needed. Using the herein disclosed semi-active antenna is expected to avoid the problems caused by long term use of an active antenna.

Semi-Active Antenna Design

The above test (FIG. 4) was performed using a standard existing arc tube and lamp design that was modified to change the passive antenna to an active one. These results should be representative of results with a semi-active antenna because, as shown in FIG. 2, a semi-active antenna is expected to provide close to the same starting voltage results as an active antenna (before the active antenna starts having Na loss problems).

A test lamp arc tube was modified to test starting reliability for different test versions of our new type of semi-active antenna. The arc tube used for the tests was the 400 Torr version of the test lamp in the FIG. 4 test (with 172 mm arc length), because it was very hard to start with a passive antenna (less than 20% likely), whereas it started 100% of the time with an active antenna. Additional tests (e.g., as shown in FIG. 7) were conducted using arc tubes with a 144 mm arc length where 500 Torr fill pressure showed critical differences in starting reliability.

Adjacent Conductor Type of Coupling Member (130)

A first type of our semi-active antenna starting aid 128, a standard passive antenna 124, preferably with a ring form of antenna end 126 is made what we call "semi-active" by adding a novel coupling member 130 indirectly connected (coupled) to the arc tube electrode 114 by a that couples one antenna end 126 to a conductive coupling end 134 (e.g., a band/ring) of a "coupling member" 128 that encircles the arc tube such that the antenna end (in this embodiment, the antenna end ring 126, although a simple end of the antenna wire 124 may work also) is spaced apart from an edge of the coupling end 134 by a uniform antenna coupling gap 136 of dimension 'g'. This embodiment is presented in drawings shown by FIGS. 5A and 5B, where typical arc tube details are also shown.

FIGS. 5C-E show embodiments representative of variants of this first kind of semi-active antenna employing a coupling member 128 constructed as an adjacent conductor type (130) of coupling member wherein an edge of a coupling end 134 (e.g., a ring) that is provided on the arc tube surface is spaced apart from one end 126 of a passive antenna (preferably printed) to form an air gap 136 for coupling over the arc tube surface. A coupling member lead 135 provides a continuous electrically conductive path between the coupling end 134 and the feedthrough 116, thereby connecting to both the electrode 114 inside the arctube, and to the power supply line (e.g., inner lamp lead 310). As illustrated and described below, the conductive path may include one or more electrically connected portions such as 138, 140, 142, 132, 120, 122, 123, 121, and/or 133. The lead 135, or portions of it, may be printed on the arctube or end plug; or may be a wire, a band, a washer, a frame, an end cap, or other suitable conductive materials as disclosed. At least one conductive element (e.g., coupling connector 132, plus others as needed) electrically connects the coupling end 134 to the electrode 114 by way of the electrode feedthrough 116. The coupling end 134 of the coupling member 128, 130 may take the form of, for example, a wide or narrow band, a wire ring, an end cap completely covering the arc tube end portion (which may also cover the end face of the arc tube and plug, like a cylindrical cup), and the like.

FIG. 5E shows a preferred embodiment that may be the best version in terms of manufacturability and accuracy of coupling gap 136 because the coupling ring is precisely positioned by printing it at the same time that the antenna end ring is printed. The electrical connection is established by clamping a metal coupling connection band around a second printed ring that is separated from the important coupling gap and connected by a printed connection between rings. Due to the precise control of coupling gap that this allows, small gaps (e.g., gap dimension g is less than 0.5 mm) might be achievable. For example, the tolerance on the gap dimension could be plus/minus 100 microns (+/−0.1 mm) the same as the stripe width tolerance indicated in FIG. 6.

The coupling ring may be, for example, a separate metal conductor assembled on a finished arc tube as a pre-form, or a length of material that is wrapped, clamped, and/or welded in place with a suitable electrical connection. It may be moly, tungsten, tantalum and the like. The antenna is preferably printed according to known processes. As shown in FIG. 6, the coupling ring and/or coupling connection may also be applied/bonded to the arc tube surface in a "printing" type of process, preferably at the same time.

FIGS. 5F, 5Fa and 5Fb show variations of a type 130*f* coupling member wherein printed conductors are used for the coupling end 134 and the coupling lead 135 that electrically connects the coupling end 134 to the feedthrough 116. These figures illustrate exemplary coupling lead printing methods and frame modifications that may be used for three configurations of end plug 112. FIG. 5Fb shows an arctube body 102 with an commonly used end cap style of plug 112, also shown in the typical arc tube illustrations of FIGS. 5A-5E, 8A, and 9B. For printed conductors, two other end plug variations are presented in FIGS. 5F and 5Fa that use an internal plug style to make it easier to print around the end of the arctube by repositioning the frit 111. FIG. 5F shows an indented plug 112 which may be a preferred embodiment. FIG. 5Fa shows the internal plug 112 having an outer face 113 that is flush with the arctube end 108 (i.e., the plug is not indented).

The printed wire for the coupling connector 132 wraps around the arctube end 108 to enable electrical connection to the electrode by being pressed against metal frame parts that are welded to each other and to the electrode feedthrough 116. The figures show one or more of the connector 132 extension portions 132*a*, 132*b*, and 132*c* that may be printed on the arctube end 108, on the inner wall 106, and on the plug outer surface 113, respectively. This may mean that the printed connector must cross a gap that may have frit 111 fused in place to seal the plug 112 to the arc tube body 102. In the FIG. 5F embodiment, using an indented insert type of plug 112 enables printing on the arctube end 108 and inner wall 106 without having to cross a frit line, and optionally on the plug surface 113 after crossing frit.

Referring first to the coupling member 130*f* embodiment in FIG. 5F, the frame 120 is specially shaped to minimize contact resistance by being cupped, i.e., having indent portions 120*a* and 120*b* for pressing against conductor portions 132*b* and 132*c* respectively (if present). A spring bias may be incorporated in the indent portions to help apply pressure. It can also be seen that the original part of the frame 120 (i.e., the vertical face) is aligned to contact the conductor portion 132*a* printed on the arctube end 108. Although the frame connector 122 should be able to apply some pressure, extra bias and more uniform pressure may be effected by attaching a metal washer-like element 123, which may be arbitrarily shaped, for example rectangular as shown. Welding may be done according to best practices. Suggested weld locations are indicated but not required.

It also should be noted that the end 121 of the frame 120 (i.e., the edge of the hole cutout for the feedthrough) may be close, if not touching the feedthrough 116 and this could be used to establish electrical connection and/or mechanical leverage for applying pressure on the coupling conductor 132. Similarly, if the conductor extension 132*c* is applied on the plug outer face 113, then its end 133 might be able to directly contact the feedthrough.

FIGS. 5Fa-5Fb are partial views of the starting aid concept from FIG. 5F showing variants of the concept implemented with two different end plug configurations, which can be seen to determine the nature of the conductor extensions and corresponding ways to contact the conductor. The frame 120 is vertically flat, not cupped, and could be held against the coupling conductor 132 by the frame connector 122, but (as with the cupped frame) preferably a more rigid washer 123 is used to apply firm pressure for holding the frame 120 against the conductor portions 132*a* and/or 132*c*.

In general mechanically forced contact between conductors is used to provide direct, low resistance electrical connection of the electrode (feedthrough/lead) to the coupling member components.

FIG. 6 is a construction drawing type view of an arctube having coupling member elements printed on the arctube along with a standard (existing) antenna, designed according to the present invention as shown in FIG. 5E.

In tests of semi-active antenna prototype designs, we were able to achieve starting reliability comparable to that of an active antenna. Best results for coupling across a gap 136 dimension "g" of about 0.5 mm up to and including about 1.0 mm. Reliable starting was achieved for gaps in this range, as shown by the results in FIG. 7 which tested the FIG. 5E type coupling member 130*e*, which was made using the arc tube of FIG. 6 (which shows prototype dimensions suitable for an arc length of about 144 mm). The FIG. 7 test results show 100% starting reliability with the semi-active antenna at both 400 and 500 Torr fill pressures, but the existing standard antenna starting aid (passive) became very unreliable when the fill pressure was increased from 400 to 500 Torr. For the four 500 Torr arctubes with passive antennas only one started reliably, another had only unacceptably delayed starts, and two had delayed starts for at least half of the attempts and either 20% or 0% success for the rest of the attempts.

In other words, an embodiment of the inventive semi-active antenna starting aid 128 was shown to enable 500 Torr gas filling in an HPS arctube with an arc length (144 mm) that would not start reliably with the existing passive antenna starting aid. Thus the present invention enables performance enhancements by increasing fill pressure, for example, without introducing degradation that active antennas cause.

Regarding other coupling air gap 136 dimensions "g" (for the adjacent conductor type of coupling member 130):

Dimension g greater than 1.0 mm still needs testing. We expect an upper limit of 1 to possibly 3 mm, but most likely around 1 mm.

Dimension g less than 0.5 mm is harder to achieve but is expected to be effective down to a lower limit of about 0.1 mm (100 microns).

In general, if the gap 136 is too wide, it performs like a passive antenna (i.e., it won't couple effectively); and if the gap 136 is too small, there will be a danger of arcing across the gap to cause probable damage to the arc tube wall, and/or to allow enough conductivity to effectively convert the starting aid into an active antenna that will cause sodium loss problems.

Layered Capacitor Type of Coupling Member (144)

FIGS. 8A-B show a second type of our semi-active antenna wherein a passive antenna (e.g., printed) is indirectly connected (coupled) to the arc tube electrode by coupling the antenna to a conductive (e.g., metal) "coupling band" that encircles the arc tube over the antenna such that the antenna 124 (in this embodiment, its end ring 126) is radially spaced apart from the coupling band by a dielectric band 148 that provides a uniform antenna "coupling gap" 150 (dimension "c"). Preferably, but not necessarily, the antenna is printed on the arc tube. To determine optimum coupling, the width of the antenna and/or the coupling band (Wm) may be varied. The dielectric band 148 should cover the antenna everywhere that it is overlapped by the coupling band 146, preferably extending beyond the boundaries of the overlapped area.

Preliminary parameters are:

Width: Wd (10 mm)>Wm (8 mm)

Thickness: Td (0.5 to 1.0 mm)

Dielectric material:

Ceramic (it has dielectric characteristic) The reason is that this position becomes very hot condition, when lamp light up, plus it needs a low thermal expansion value.

Further testing will determine optimum dimensions for overlapped areas and for dielectric thickness that determines the coupling gap. For example, may be a thickness of about 1 mm, although this will also depend upon the type of dielectric material being used.

Although this second coupling member type 144 is primarily presented as a layered capacitive coupling, our design is intended to include the possibility of a resistive coupling wherein the "dielectric band" would have a finite, predetermined electrical resistance.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. A starting aid for discharge lamp arc tubes characterized by a tubular arc tube body wall that longitudinally extends between first and second ends and surrounds an internal arc cavity wherein corresponding first and second electrodes in the arc cavity have corresponding first and second conductive feedthroughs that sealingly extend out through the first and second ends, the starting aid comprising:

an antenna being an elongated conductor extending longitudinally on the arc tube body wall between first and second antenna ends that are located radially outward of corresponding first and second electrodes; and an antenna coupling member comprising a conductive coupling member lead that is electrically connected to the first feedthrough, and extends to a coupling end located on the body wall near to the first antenna end and separated therefrom by a coupling gap of predetermined, non-zero gap dimension.

2. The starting aid of claim 1, wherein:

the coupling gap comprises an air gap, the coupling member is on an outside surface of the body wall, and both the coupling end and the antenna end extend circumferentially around the arctube.

3. The starting aid of claim 1, wherein:

the coupling gap comprises a dielectric solid material, formed as a band layered between the antenna end and the coupling end also formed as a band, both bands wrapped around the arctube body radially outward from the antenna end.

* * * * *